US011584486B2

(12) United States Patent
Senie et al.

(10) Patent No.: US 11,584,486 B2
(45) Date of Patent: Feb. 21, 2023

(54) KAYAK TYPE INFLATABLE WATERCRAFT

(71) Applicant: DECATHLON, Villeneuve D'Ascq (FR)

(72) Inventors: Nicolas Senie, Villeneuve D'Ascq (FR); Emmanuelle Pion, Villeneuve D'Ascq (FR); Diego Casas, Villeneuve D'Ascq (FR)

( * ) Notice: Subject to any disclaimer, the term of this patent is extended or adjusted under 35 U.S.C. 154(b) by 138 days.

(21) Appl. No.: 17/053,449

(22) PCT Filed: May 6, 2019

(86) PCT No.: PCT/FR2019/051031
§ 371 (c)(1),
(2) Date: Nov. 6, 2020

(87) PCT Pub. No.: WO2019/215409
PCT Pub. Date: Nov. 14, 2019

(65) Prior Publication Data

US 2021/0245847 A1 Aug. 12, 2021

(30) Foreign Application Priority Data

May 7, 2018 (FR) ..... 18 53936

(51) Int. Cl.
*B63B 34/23* (2020.01)
*B63B 34/22* (2020.01)

(52) U.S. Cl.
CPC ..... *B63B 34/23* (2020.02); *B63B 34/22* (2020.02)

(58) Field of Classification Search
CPC ..... B63B 34/23; B63B 34/22
See application file for complete search history.

(56) References Cited

U.S. PATENT DOCUMENTS 2,873,459 A * 2/1959 Marz ..... B63B 7/08 114/345
6,209,476 B1 * 4/2001 Maurel ..... B63B 7/08 441/40

(Continued)

FOREIGN PATENT DOCUMENTS

CN 205872368 U 1/2017
CN 214930461 U * 11/2021 ..... B63B 34/22

(Continued)

OTHER PUBLICATIONS

English language abstract of CN205872368.

(Continued)

*Primary Examiner* — S. Joseph Morano
*Assistant Examiner* — Jovon E Hayes
(74) *Attorney, Agent, or Firm* — Brian Gordaychik

(57) ABSTRACT

An inflatable watercraft of the kayak type including a hull including:

a longitudinal bottom comprising a central longitudinal edge and two lateral longitudinal sides, so as to have a V-shaped cross section, the bottom comprising at least one inflatable shell, and a stiffening upper structure comprising two lateral longitudinal inflatable shells and at least one transverse element mounted between the two lateral inflatable shells, each lateral inflatable shell being mounted on one of the lateral longitudinal sides of the longitudinal bottom, in which each of the two lateral inflatable shells comprises two superimposed walls, each of said walls including a textile mat and being connected together by a multitude of connecting threads distributed over the entire surface of said mats while forming a structure suited to be inflated to a pressure capable of stiffening said structure.

16 Claims, 4 Drawing Sheets

(56) References Cited

U.S. PATENT DOCUMENTS

| | | | | |
|---|---|---|---|---|
| 8,800,466 | B1 * | 8/2014 | Shimozono | B63B 39/10 114/345 |
| 9,452,809 | B2 * | 9/2016 | Hoge, Jr. | B63B 34/22 |
| 9,637,201 | B2 * | 5/2017 | Hoge, Jr. | B63B 34/22 |
| 10,526,047 | B2 * | 1/2020 | Hopkins | B32B 27/283 |
| 11,325,684 | B2 * | 5/2022 | Bai | B63B 7/08 |
| 2006/0144313 | A1 * | 7/2006 | Toussi | B63B 34/22 114/345 |
| 2011/0303139 | A1 * | 12/2011 | Hoge, Jr. | B63B 3/38 114/39.26 |
| 2018/0127061 | A1 * | 5/2018 | Willis | B63B 34/23 |

FOREIGN PATENT DOCUMENTS

| | | | | |
|---|---|---|---|---|
| FR | 2722758 | A1 | 1/1996 | |
| FR | 2795040 | A1 | 12/2000 | |
| FR | 3080834 | A1 * | 11/2019 | B63B 34/22 |
| JP | 2004175322 | A | 6/2004 | |
| KR | 101274579 | B1 * | 6/2013 | B29B 22/00 |
| KR | 101274579 | B1 | 6/2013 | |
| KR | 20150113283 | A * | 10/2015 | B63B 59/02 |
| KR | 20150113283 | A | 10/2015 | |
| WO | 2013057395 | * | 4/2013 | B63B 7/08 |
| WO | WO-2013057395 | A1 * | 4/2013 | B63B 15/02 |

OTHER PUBLICATIONS

English language abstract of KR 20150113283.
English language abstract of KR 101274579.
English language abstract of JP 2004175322.
English language abstract of FR 2722758.

* cited by examiner

KAYAK TYPE INFLATABLE WATERCRAFT

BACKGROUND

The present disclosure relates to the field of sport equipment and in particular the field of inflatable watercraft. More particularly, the present disclosure relates to kayak type inflatable watercraft.

There already exist inflatable watercrafts for the practice of kayaking. Such watercrafts are in particular described in document U.S. Pat. No. 9,452,809. Watercrafts of this type are formed of a plurality of inflatable elements, for example of materials called "dropstitch," assembled together so as to obtain a watercraft having the general shape of a kayak.

Such watercrafts, however, due to their inflatable structure, require an architecture leading to a shape which is not always suitable or which is not the most favorable for the practice of kayaking. Thus document U.S. Pat. No. 9,452,809 discloses an inflatable watercraft having a flat bottom which is not suited to the practice of kayaking on a sea with swells. Moreover, the watercraft also does not have a hydrodynamic hull surface allowing high-performance behavior of the watercraft on the water.

There also exist watercrafts of the boat type, in which only the floor is formed by a so-called "dropstitch" material, in in which the sides of the watercraft are formed by cylindrical inflatable elements. Watercrafts of this type are in particular described in documents FR 2 795 040 or FR 2 722 758.

However, such structures relate most often to motorized watercrafts, and not to watercrafts for kayaking. In particular, the cylindrical inflatable elements located on the sides and forming the main flotation elements of the watercraft, generally have considerable bulk in order to confer sufficient stiffness and buoyancy to the watercraft.

SUMMARY

The present disclosure aims to resolve the different technical problems previously mentioned. In particular, the present disclosure aims to supply a watercraft of the kayak type having both a hydrodynamic shape approaching that of rigid kayaks, while retaining the necessary buoyancy and stiffness for an inflatable watercraft.

Thus, according to one aspect, an inflatable watercraft of the kayak type is proposed, comprising a hull. The hull includes:

a longitudinal bottom comprising a central longitudinal edge and two lateral longitudinal sides, so as to have a V-shaped cross section, the bottom comprising at least one inflatable shell, and a stiffening upper structure comprising two lateral longitudinal inflatable shells and at least one transverse element mounted between the two lateral inflatable shells, each lateral inflatable shell being mounted on one of the lateral longitudinal sides of the longitudinal bottom.

Each of the two lateral inflatable shells comprises two superimposed walls, each of said walls including a textile mat and being connected together by a multitude of connecting threads distributed over the entire surface of said mats while forming a structure suited to be inflated to a pressure capable of stiffening said structure.

The structure of the inflatable watercraft according to the present disclosure thus includes several independent volumes formed from a material of the "dropstitch" type. The different volumes allow in particular, thanks to the high inflation pressure which can be used with the "dropstitch" material, obtaining elements having a high stiffness despite the inflatable nature of the watercraft. Especially, the stiffening upper structure forms a sort of cockpit for the user and reinforces the structure of the bottom of the watercraft, where the weight of the user is directly applied. Thanks to this reinforcement contributed by the stiffening upper structure, it then becomes possible to design the bottom of the watercraft with a V-shaped cross section, i.e. with a hydrodynamic hull surface facilitating the movement of the watercraft on the surface of the water. In particular, the stiffening structure of the watercraft allows limiting the deformations of the bottom, even with a V-shaped cross section, and to retain the general shape of the hull surface even when the user is positioned in the middle of the watercraft and applies his weight there.

Optionally, the two lateral inflatable shells are not oriented, in cross section, like the faces of the longitudinal bottom on which they are mounted. The lateral inflatable shells may be mounted vertically on the longitudinal bottom.

The bottom may be formed of at least one inflatable shell, for example one or two inflatable shells. Thus, the bottom can be formed by a single inflatable envelope of dropstitch which is patterned so as to obtain the desired cross section, and more particularly the hull surface but also the bow of the watercraft. Alternatively, it is also possible to provide a bottom formed from two inflatable shells, forming the two longitudinal sides of the bottom and assembled along the central longitudinal side of the bottom. Here again, the dropstitch material is advantageously patterned so as to obtain, once the two inflatable shells are assembled together, the desired hull surface, and possibly the bow and the stern, for the watercraft.

The stiffening upper structure may be formed of two lateral longitudinal inflatable shells and of one or two transverse elements mounted between the two lateral inflatable shells.

The stiffening upper structure is positioned centrally relative to the bottom, i.e. in the user-occupied area. It is in fact in this area that the greatest forces will be exerted due to the weight applied locally by the user on the hull of the watercraft. The stiffening upper structure thus includes two longitudinal elements on either side of the user-occupied area, in order to reduce the buckling of the bottom when the user takes his position in the watercraft: the two lateral longitudinal inflatable shells maintain a distance between the two longitudinal ends of the bottom. Moreover, the transverse elements of the stiffening upper structure allow maintaining in place the two lateral longitudinal inflatable shells, and avoid in particular that they approach one another, still under the influence of the weight exerted by the user in the kayak. Thus, the stiffening upper structure is designed to retain a substantially constant general shape, and is then placed above the bottom in the area accommodating the user, to maintain the general shape of the bottom, and therefore its hydrodynamic characteristics, despite its V-shaped cross section.

The inflatable shell of the bottom may comprises two superimposed walls, each of said walls including a textile mat and being connected together by a multitude of connecting threads distributed over the entire surface of said mats while forming a structure suited to be inflated to a pressure capable of stiffening said structure. The use of a bottom of dropstitch material then allows obtaining rigid surfaces favoring the slipping of water over their surface.

Each lateral inflatable shell may have a longitudinal length smaller than the length of the longitudinal bottom, and each lateral inflatable shell may be mounted on a portion of one of the lateral longitudinal sides of the longitudinal bottom.

The lateral longitudinal inflatable shells are designed shorter than the bottom, in order to have greater stiffness, and are positioned in the middle of the watercraft, where the user will occupy it and apply stresses to the hull due to his weight, particularly buckling stresses leading the two longitudinal ends of the bottom to rise and to move closer together: the location of the stiffening upper structure above the bottom therefore allows limiting this type of buckling.

The inflatable watercraft may also comprise a stern and a bow, and the stern and/or the bow of the kayak may be formed by a longitudinal end of the longitudinal bottom. As previously indicated, thanks to the stiffening upper structure, it becomes possible to provide a bottom extend until the two longitudinal ends of the watercraft, and therefore being able to form the bow and stern of the watercraft. Thus a hull is obtained in which the outer surface on which the water slips during the movement of the watercraft is continuous and delimits, over the entire length of the hull, a single inflatable volume. Thus the turbulence over the submerged surface of the hull, and therefore the friction slowing the progress of the watercraft, is reduced.

The hull may include two upper longitudinal sides formed by the two lateral inflatable shells of the stiffening upper structure, and by the lateral longitudinal sides of the longitudinal bottom.

Each of the lateral longitudinal edges of the longitudinal bottom may be formed, in the longitudinal direction, of a central portion and of two end portions, the central portion being lower than the two end portions, and each lateral inflatable shell comprises an upper longitudinal side.

The two lateral inflatable shells and the stiffening upper structure may be positioned in the holes or notches of the longitudinal bottom, in order to form, together, substantially planar upper longitudinal edges.

Each lateral inflatable shell may be mounted on the central portion of one of the lateral longitudinal sides of the longitudinal bottom, and each lateral inflatable shell may have a height corresponding to the difference in height between the central portion and the end portions of the lateral longitudinal side on which it is mounted, so that the upper longitudinal side of each lateral inflatable shell forms, with the end portions of the lateral longitudinal side on which it is mounted, an upper longitudinal side of the hull, possibly substantially rectilinear.

A general hull shape is thus obtained which does not allow identifying at first sight the volume of the bottom and the volume of the stiffening upper structure: the two volumes are designed and assembled together so as to form a standard general hull shape.

Each of the lateral inflatable shells may comprise an inner wall, an outer wall and a lateral side connecting together the inner and outer walls. The inner and outer walls can be the two superimposed walls each including a textile mat and connected together by a multitude of connecting threads.

The inner wall of the longitudinal bottom and the lateral inflatable shells may delimit or define at least partially the inner volume of the watercraft.

The lateral shells may be mounted, transversely to the longitudinal direction, in continuation of the bottom, so as to also delimit, at least partially, the inner volume of the watercraft. Thus, the inner walls of the hull are formed by the inner wall(s) of the longitudinal bottom and by the inner walls of the lateral inflatable shells.

Likewise, the outer and inner walls of the later inflatable envelopes may be mounted, transversely to the longitudinal direction, in continuation of the inner and outer walls of the longitudinal bottom.

The transverse element may be mounted on the two lateral inflatable shells. The transverse element can be mounted on the highest portions of the lateral inflatable shells, e.g. on or in proximity to the lateral upper side of the lateral inflatable shells.

The stiffening upper structure may comprise two transverse elements mounted at a distance from one another between the two lateral inflatable shells.

The transverse element(s) are inflatable, each for example comprising two superimposed walls, each of said walls including a textile mat and being connected together by a multitude of connecting threads distributed over the entire surface of said mats while forming a structure suited to be inflated to a pressure capable of stiffening said structure.

The two transverse elements of the stiffening upper structure can also be of dropstitch material, in particular in order to also be inflatable while having sufficient stiffness to maintain the spacing of the two lateral inflatable shells. Moreover, the stiffening upper structure can comprise two transverse elements, preferably intended to be positioned respectively in front of and behind the user when he is occupying the watercraft, in order to form a stiffening "peripheral enclosure" completely surrounding the user.

The inflatable watercraft may also comprise a deck, possibly a flexible deck, mounted above the hull, particularly at the front and rear of the watercraft. The deck may extend from one longitudinal end of the hull to the other, e.g. from the stern until the bow. The deck is important for a kayak because it allows limiting the entry of water into the watercraft. Nevertheless, to be effective, it must be flat, or taut in the case of a flexible deck, in order to facilitate the removal of water and limit the formation of water pockets. Thus, a deck of this type is generally absent or partial in inflatable watercraft, because the inflatable structure of the hull, and its stiffness, do not allow it to be sufficiently taut.

The deck can include, possibly at the rear of the watercraft, an access opening to the interior of the watercraft. An opening of this type allows access to the inner volume of the kayak, possibly to use it as a storage space for the personal effects of the user for example, or for safety accessories.

The watercraft can also include a closing means, possibly watertight, comprising a sleeve delimited by two open ends, one of the open ends being mounted on the deck around the access opening.

The sleeve may include a rectangular contour with large and small faces.

A closing means of this type allows guaranteeing a minimum watertightness limiting the entries of water into the watercraft. In fact, the closing means is inspired by the roll-up closures of certain bags, which are watertight for a given period or under predetermined conditions. In the case of the present closing means, the sleeve is designed to fold and/or roll over itself in order to make it more watertight. Moreover, the closing means remains flexible, like the rest of the watercraft, which allows easier storage when the watercraft is deflated.

The closing means, possibly watertight, also includes stiffening elements mounted on the small sides of the rectangular contour, preferably in proximity to the open end mounted on the deck. The stiffening elements can even be designed to adhere to one another by contact, in order to further improve the watertightness of the closing means.

The stiffening elements extend between the fold lines provided to facilitate the folding of the sleeve into a rolled-up configuration. The stiffening means are designed to facilitate the folding of the sleeve, this only being feasible along the lines delimited by the stiffening elements (which, for their part, are difficult to fold).

The inflatable watercraft may also include foot braces. What is meant here by "foot braces" is the complete system allowing the user to rest his foot on a support surface, e.g. the system with the support surface and a means of attachment to the watercraft, and possibly a means of adjusting the position of the support surface.

The foot braces comprise two support surfaces mounted sliding along the supports, the supports being attached inside the watercraft and including flexible rods, preferably two parallel flexible rods. The rods are for example bolt rope rods. The rods thus form a support having both sufficient mechanical strength to allow the support surfaces to slide on them, as well as a certain flexibility allowing the folding of the watercraft when it is deflated.

The foot braces also include two adjustment straps, each connected between a support surface and an element integral with the hull, for example a loop, located in proximity to the user positioned in the kayak. The adjustment straps allow the user to move the support surfaces along the rods, and to hold them in position. Thus, during adjustment, the user unlocks the straps so as to allow free positioning of the support surfaces: he then need only press on the support surfaces to push them along the rod. Then, once settled in, the user need only pull on the straps to move the support surfaces closer to him: when they are at the right distance, the straps can then be locked to retain the support surfaces in position.

The watercraft may also comprise a coaming mounted on the deck and allowing the user to attach a skirt to it. The coaming allows a skirt to be mounted on the deck, and therefore to close the opening in the deck allowing the entry of the user into the kayak, in order to further limit the entry of water into the watercraft.

The coaming may be formed from a longitudinal elastomeric strip surrounding an opening of the deck intended to accommodate the user. The coaming is conventionally of rigid material, like the deck. In the case of the present disclosure, the coaming is selected of an elastomeric material, in order to have both mechanical resistance for the attachment of the skirt, but also a certain flexibility for storing the watercraft in the deflated condition.

The coaming may have a cross section including a curved lip forming a hook mounted on a base, the base being intended to be attached to the deck of the kayak, and the lip being configured to retain the elastic band of the skirt.

The watercraft may also comprise a removable seat and two blocks, the two blocks being mounted on the inner wall of the hull, possibly at the junction between the longitudinal bottom and the lateral inflatable shells, and the seat including a seat cushion with holes with a shape complementary to that of the blocks and configured to cooperate with the blocks.

The seat of the watercraft is designed to be removable, so as not to interfere with the folding of the watercraft when it is deflated. Moreover, the watercraft also includes two blocks allowing positioning and retaining the seat in the hull during the practice of kayaking. In particular, the blocks, which may be positioned under the seat cushion of the seat, are located at the junction between the longitudinal bottom and the lateral inflatable shells. In this manner, with a substantially horizontal seat cushion, there will remain below the seat a space due to the V-shaped geometry of the longitudinal bottom which will allow, on the one hand, possibly collecting the water which may have entered into the hull, without soaking the seat cushion, and on the other hand a deformation of the seat cushion under the weight of the user, for greater comfort.

The seat can include a backrest intended to be supported on the transverse element of the stiffening upper structure. In this case, the presence of the transverse element, which is rigid, is used as a support for the seat. Thus the design of the seat is facilitated, and particularly the connection between the seat cushion and the seat.

The watercraft may also comprise at least one additional removable seat, and at least two additional blocks.

BRIEF DESCRIPTION OF THE DRAWINGS

The disclosure and its advantages will be better understood upon reading the detailed description of a particular embodiment, taken by way of an example which is in no way limiting and illustrated by the appended drawings in which.

DETAILED DESCRIPTION

Figure 1:
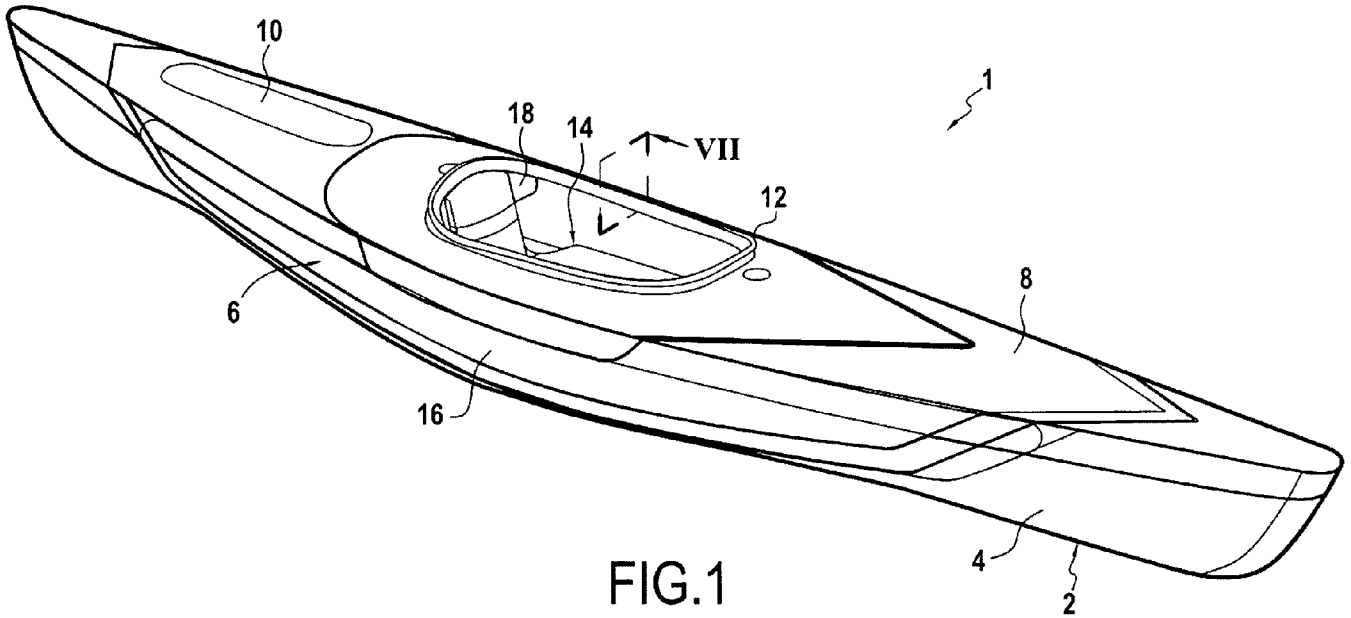
FIG. 1 is a schematic view of an inflatable kayak according to the present disclosure.

FIG. 1 illustrates schematically an inflatable kayak type watercraft 1.

The inflatable kayak 1 includes a hull 2, which is formed by a longitudinal bottom 4 and a stiffening upper structure 6, a deck 8 with a rear access opening 10 and a coaming 12, and a seat 14. The kayak 1 comprises a bow in front and a stern in the rear located at the two longitudinal ends of the kayak, and particularly of the hull 2.

The stiffening upper structure 6 comprises two lateral inflatable shells 16 and two transverse elements 18 which will be described in particular with FIG. 6.

Figure 2:
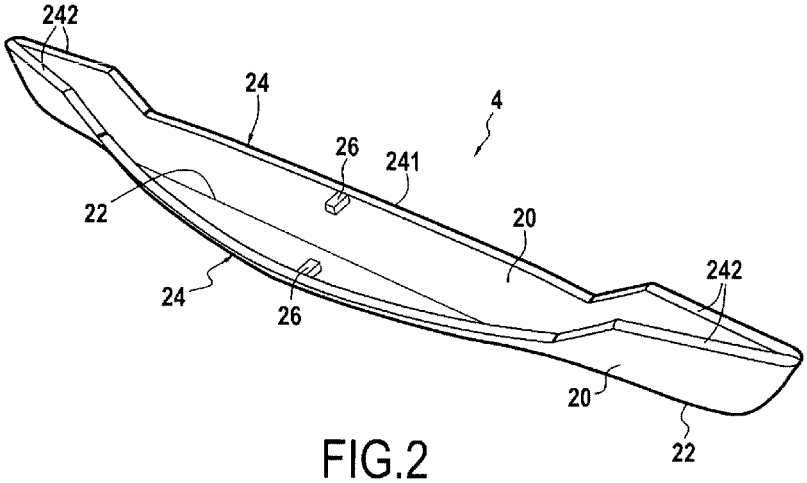
FIG. 2, FIG. 3, and FIG. 4 show the different portions and the assembly of the hull of the kayak shown in FIG. 1.

As can be seen in FIG. 2, the longitudinal bottom 4 includes two longitudinal faces 20 which join in the middle along a central longitudinal side 22 of the longitudinal bottom 4, and forming, on the outer faces, two lateral longitudinal sides 24 of the longitudinal bottom 4. The two longitudinal faces 20 join in the middle at an angle, so that the longitudinal bottom 4 has a V shaped cross section.

The angle of the longitudinal bottom 4 at the central longitudinal side 22 can vary depending on whether the cross section considered is located in proximity to a longitudinal end of the longitudinal bottom 4 or in proximity to the median portion of the longitudinal bottom 4. Thus, in proximity to the ends, the cross section of the longitudinal bottom 4 can have a V shape with an acute angle, less than 90°. Conversely, the median cross section of the longitudinal bottom 4 can have a V shape with an obtuse angle, i.e. greater than 90°, allowing giving more space, particularly in width, to accommodate the user. Moreover, at the longitudinal ends of the longitudinal bottom 4, i.e. at the front end and the rear end of the hull 2, the two longitudinal faces 24 can join to form respectively the bow at the front of the hull 2 and the stern at the rear of the hull 2.

Each of the two faces 22 of the longitudinal bottom 4 can be formed from an inflatable shell patterned so as to allow obtaining the desired shape of the longitudinal bottom 4 when the two faces are assembled together. Alternatively, the two faces 22 can be formed from a single inflatable shell patterned to obtain the desired shape: in this case, the longitudinal bottom 4 can be inflated or deflated by means of a single inflation valve. In both cases, where the inflatable shells used to form the longitudinal bottom 4 are preferably inflatable shells made of dropstitch, i.e. inflatable shells comprising two superimposed walls, each of said walls comprises a textile mat and being connected together by a multitude of connecting threads distributed over the entire surface of said mats while forming a structure suited to be inflated to a pressure capable of stiffening said structure.

The use of the dropstitch material allows using a high shell inflation pressure, and therefore obtaining high stiffness of the shell in the inflated condition. In the case of the longitudinal bottom 4, such stiffness allows facilitating the flow of water along the submerged surface of the bottom, and therefore limiting the forces to be supplied by the user to make the kayak progress.

Moreover, the dropstitch material allows obtaining inflatable volumes with the desired shapes, and particularly substantially planar, and not cylindrical shapes, limiting the bulk of the kayak.

In order to allow the installation and the proper positioning of the seat 14 in the hull 2 of the kayak, the longitudinal bottom 4 can also comprise two blocks 26, for example of rigid foam, which cooperate with corresponding holes in the seat 14. The blocks 26 are preferably mounted on the inner wall of the longitudinal bottom 4, and more preferably in proximity to the lateral longitudinal sides 24: in this manner, the seat cushion of the seat 14 is located at a distance from the central longitudinal side 22 and can then be deformed under the weight of the user to provide him greater comfort. In order to avoid the reverse installation of the seat 14 in the hull 2, the blocks 26 can be mounted offset relative to one another, i.e. at a different distance from the median cross section of the longitudinal bottom 4: in this manner, the seat 14 can only be installed in the hull in the correct direction.

As will be detailed below, the lateral longitudinal sides 24 of the longitudinal bottom 4 have a central portion 241 and end portions 242, the central portion 241 of each lateral longitudinal side 24 being lower than the end portions 242, i.e. having a height with respect to the central longitudinal side 22 that is smaller than the height of the end portions 242.

Figure 3:
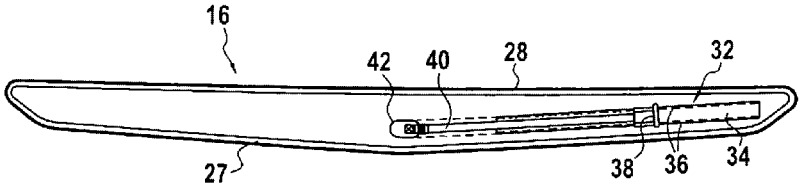

FIG. 3 illustrates a side view of a lateral inflatable shell 16, and more particularly the inner wall of a lateral inflatable shell 16. The lateral inflatable shell 16 is formed from a dropstitch material, i.e. inflatable shells comprising two superimposed walls, each of said walls including a textile mat and being connected together by a multitude of connecting threads distributed over the entire surface of said mats while forming a structure suited to be inflated to a pressure capable of stiffening said structure. The lateral inflatable shell 16 is intended to be mounted on a lateral longitudinal side 24, and more particularly on the central portion 241 of the longitudinal bottom 4.

Thus the lateral inflatable shell 16 can have a longitudinal length substantially equal to the length of the central portion 241 of the lateral longitudinal side 24, as well as a height substantially equal to the difference in height between the central portion 241 and the end portions 242 of the lateral longitudinal side 24. The lateral inflatable shell 16 can have a height at its central portion which is greater than the height at the ends. In this manner, the lateral inflatable shell 16 can be positioned in the central portion 241 so that the lower longitudinal side 27 of the lateral inflatable shell 16 is attached to the central portion 241 of the lateral longitudinal side 24, and that the upper longitudinal side 28 of the lateral inflatable shell 16 is positioned in the continuation of the end portions 242 of the lateral longitudinal side 24, to form a substantially rectilinear, or substantially horizontal, upper longitudinal side 30 of the hull 2 (see FIG. 4).

Each lateral inflatable shell 16 can also comprise a foot brace 32 mounted on its inner wall. The foot brace 32 can thus comprise a support 34 including two flexible, mutually parallel rods 36. The rods 36, though flexible, have sufficient stiffness to allow guiding along the support 34 a support surface 38. The support surface 38, which is intended to serve as a support for the foot of the user during his practice, can have for example two grooves with a shape corresponding to the two rods in order to be able to slide along the rods. An adjustment strap 40 is mounted between the support surface 38 and a loop 42 integral with the inner wall of the lateral inflatable shell 16: by exerting a force on the adjustment strap 40 at the loop 42, it then becomes possible to move it closer to the support surface 38 of the loop 42 while remaining on the seat 14 of the kayak 1. Moreover, once the support surface 38 is correctly positioned, it is sufficient to block the adjustment strap 40 to avoid having the support surface 38, move away from the loop 42 under the influence of the stresses exerted by the user during his practice.

Figure 4:
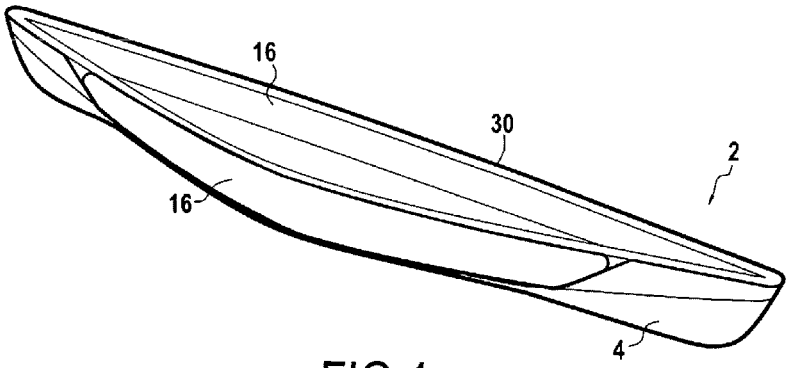
Figure 5:
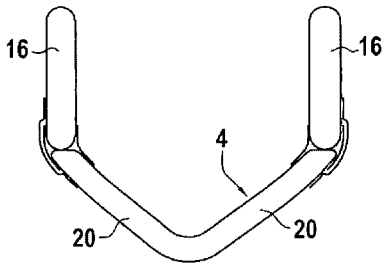
FIG. 5 is a section view of the hull shown in FIG. 4.

FIG. 4 illustrates the hull 2 of the kayak with the longitudinal bottom 4 and the two lateral inflatable shells 16: it is then noted that the addition and the positioning of the two lateral inflatable shells 16 allow limiting the buckling of the longitudinal bottom 4, for example when a user applies his weight to the median portion of the hull 2. As can be seen in FIG. 5, the two lateral inflatable shells 16 are not oriented, in cross section, like the faces 20 of the longitudinal bottom 4 on which they are mounted. Thus, the lateral inflatable shells 16 are inclined relative to the faces 20, and may be oriented substantially vertically. This is particularly notable at the median cross section of the hull 2 at which the longitudinal bottom 4 has a V shaped cross section with an obtuse angle. The lateral inflatable shell 16, thanks to its greater height in its median portion, allows compensating the difference in height of the longitudinal bottom along the central portion 241 of the lateral longitudinal side 24. A geometry of the walls of the hull 2 of this type allows increasing the stiffness and limiting the buckling of the different components of the hull 2.

Figure 6:
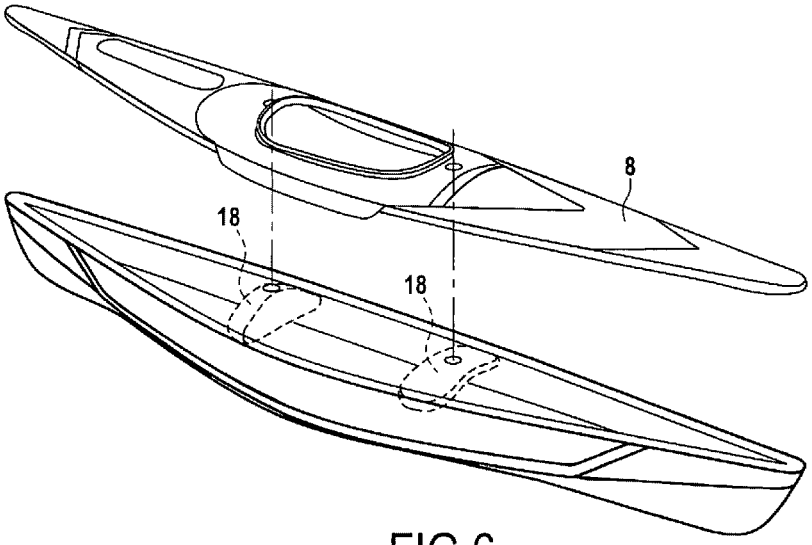
FIG. 6 illustrates the mounting of the deck on the hull of the kayak.

FIG. 6 illustrates the hull 2 with two transverse elements 18, on which will be mounted the deck 8. The transverse elements 18 are mounted on and between the two lateral inflatable shells 16, possibly at a distance from one another. They allow, on the one hand, maintaining their spacing, but also their substantially vertical, and therefore parallel orientation. The transverse elements 18 may be inflatable, and formed from a dropstitch material as described previously in order to have the desired stiffness in the inflated condition.

In this manner, the lateral inflatable shells 16 and the transverse elements 18 form a sort of cockpit inside which the user is intended to settle himself, and reinforcing the stiffness of the longitudinal bottom 4. The transverse elements 18 may therefore be positioned in front of and behind the seat 14 of the user. The rear transverse element 18 can serve as a support for the backrest of the seat 14.

Figure 7:
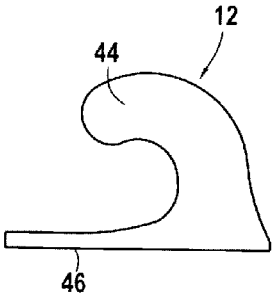
FIG. 7 is a section view of the coaming illustrated in FIG. 1, and FIG. 8 and FIG. 9 illustrate different views of the closing means of an access opening of the deck of the kayak.

The deck 8 can then be mounted on the hull 2 in order to close its upper surface, with the exception of the opening provided for the entry of the user into the kayak 1. In order to avoid the entry of water through the user opening during practice, the deck 8 comprises a coaming 12 for the attachment of a skirt (not shown). As illustrated in FIG. 7, the coaming is formed of a longitudinal elastomeric strip surrounding the user opening. The selection of an elastomeric material allows retaining a sufficiently flexible element for the folding of the kayak 1 when it is deflated, while still allowing sufficient mechanical strength to allow retaining the skirt of the user.

The coaming 12 can include, in cross section, a curved lip 44 forming a hook. The shape of the lip allows slipping onto it the elastic band of the skirt so that it remains engaged in the lip 44. The curved lip 44 is mounted on a substantially flat 46, intended to be attached to the upper surface of the deck 8.

The deck 8 also includes the rear access opening 10 allowing the user to store possessions inside the rear portion of the kayak 1. In order to prevent water from entering into the hull 2 through the access opening 10, the kayak 1 comprising a closing means 48 illustrated in FIG. 8 in its closed configuration and in FIG. 9 in an open configuration. The closing means 48 may be made watertight by rolling up: the closing means 10 thus includes a sleeve 50 with a rectangular contour with large faces 52 and small faces 54 which surround the periphery of the access opening 10. One of the ends of the sleeve 50, the lower one, is attached to the deck 8, around the access opening 10. The other end of the sleeve 50, the upper one, also includes stiffening strips 56 allowing facilitating the manipulation of the open end of the closing means 48. The sleeve 50 also includes stiffening elements 58, possibly on the small faces 54 of the sleeve 50 which extend between the fold lines 60 provided to facilitate the folding of the sleeve 50 into a rolled-up configuration. In this manner, the user can only easily roll up the sleeve 50 by folding it along the fold lines 60 provided for this purpose: the utilization and efficiency of the closing means 48 is thus improved. Straps 62 can then be provided to retain the closing means 48 in the closed condition.

Figure 8:
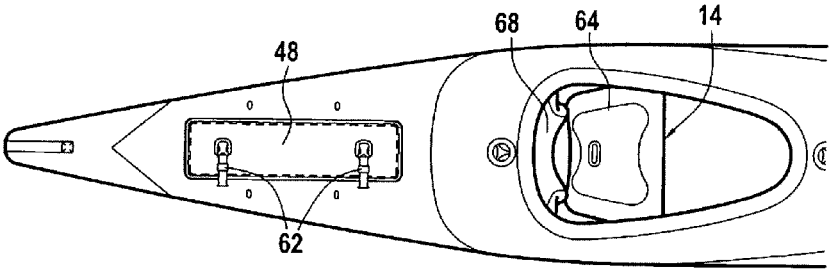
Figure 9:
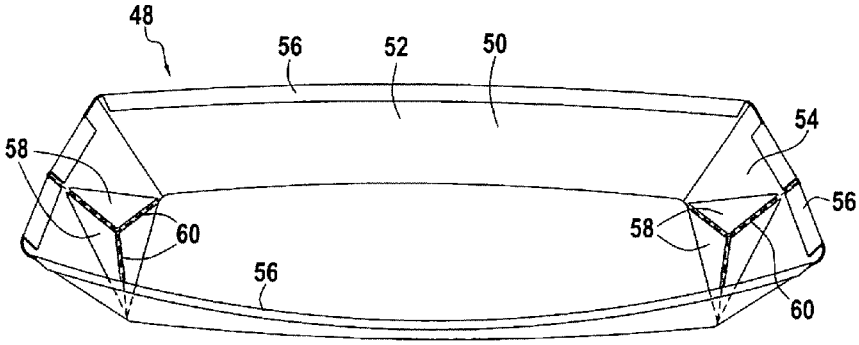

As illustrated in FIG. 8, the seat 14 can comprise a seat cushion 64 and a backrest 68. The seat cushion 64 is designed to include holes on its lower face, in order to cooperate with the blocks 26 of the hull 2. It is thus possible to obtain a correct orientation of the seat 14 in the kayak 1, as well as retaining it in the longitudinal direction of the kayak.

Moreover, the backrest 68 is connected to the seat cushion by a pivot connection, which can be a simple flexible connection. In order to hold the backrest 68 in position, and for example upright in the kayak 1, it can be supported against a transverse element 18, or fixed to a transverse element 18 for example with a means of the hook-and-pile type.

Thus, thanks to the design of the hull, and particularly to its two-part structure with a longitudinal bottom and a stiffening upper structure, it becomes possible to manufacture a kayak with an aerodynamic shape similar to that of rigid kayaks, while still having mechanical strength, and in particular high resistance to buckling for an inflatable watercraft. Moreover, the selection and the design of accessories equipping the kayak allows retaining a flexible structure, without a rigid part that could damage the structure during folding.

The invention claimed is:

1. An inflatable watercraft comprising a hull including:

a longitudinal bottom comprising a central longitudinal edge and two lateral longitudinal sides, so as to have a V-shaped cross section, the bottom comprising at least one inflatable shell, a stiffening upper structure comprising two lateral longitudinal inflatable shells and at least one transverse element mounted on and between the two lateral inflatable shells, each lateral inflatable shell being mounted on one of the lateral longitudinal sides of the longitudinal bottom, and a removable seat, wherein each of the two lateral inflatable shells comprises two superimposed walls, each of said walls including a textile mat and being connected together by a multitude of connecting threads distributed over the entire surface of said mats while forming a structure suited to be inflated to a pressure capable of stiffening said structure.

2. The inflatable watercraft of claim 1, wherein the inflatable shell of the bottom comprises two superimposed walls, each of said walls including a textile mat and being connected together by a multitude of connecting threads distributed over the entire surface of said mats while forming a structure suited to be inflated to a pressure capable of stiffening said structure.

3. The watercraft according to claim 1, wherein each lateral inflatable shell has a longitudinal length smaller than the length of the longitudinal bottom, and in which each lateral inflatable shell is mounted on a portion of one of the lateral longitudinal sides of the longitudinal bottom.

4. The watercraft according to claim 1, also comprising a stern and a bow, and in which the stern or the bow of the kayak is formed by a longitudinal end of the longitudinal bottom.

5. The watercraft according to claim 1, wherein the hull includes two upper longitudinal sides formed by the two lateral inflatable shells of the stiffening upper structure, and by the lateral longitudinal sides of the longitudinal bottom.

6. The watercraft according to claim 1, wherein each of the lateral longitudinal sides of the longitudinal bottom is formed, in the longitudinal direction, of a central portion and of two end portions, the central portion being lower than the two end portions, and in which each lateral inflatable shell comprises an upper longitudinal side.

7. The watercraft according to claim 6, wherein each lateral inflatable shell is mounted on the central portion of one of the lateral longitudinal sides of the longitudinal bottom, and wherein each lateral inflatable shell has a height corresponding to the difference in height between the central portion and the end portions of the lateral longitudinal side on which it is mounted, so that the upper longitudinal side of each lateral inflatable shell forms, with the end portions of the lateral longitudinal side on which it is mounted, an upper longitudinal side of the hull.

8. The watercraft according to claim 1, wherein the transverse element is inflatable, and comprises two superimposed walls, each of said walls including a textile mat and being connected together by a multitude of connecting threads distributed over the entire surface of said mats while forming a structure suited to be inflated to a pressure capable of stiffening said structure.

9. The watercraft according to claim 1, also comprising a deck mounted above the hull, wherein the deck includes an access opening to the interior of the watercraft, and wherein the watercraft also includes a closing means, comprising a sleeve with a rectangular contour including first and second faces, the first faces being larger than the second faces, the sleeve being delimited by two open ends, one of the open ends being mounted on the deck around the access opening and the closing means also including stiffening elements mounted on the second faces of the rectangular contour, the stiffening elements extending between the fold lines provided to facilitate the folding of the sleeve into a rolled-up configuration.

10. The watercraft according to claim 1, also comprising foot braces with two support surfaces mounted sliding along the supports, the supports being attached inside the watercraft and including one or more flexible rods, and the foot braces also including two adjustment straps, each connected between a support surface and an element integral with the hull located in proximity to the user positioned in the kayak.

11. The watercraft according to claim 1, also comprising a coaming mounted on the deck and allowing the user to attach a skirt to it, the coaming being formed from a longitudinal elastomeric strip surrounding an opening of the deck intended to accommodate the user, and having a cross section including a curved lip forming a hook mounted on a base, the base being intended to be attached to the deck of the kayak, and the lip being configured to retain the elastic band of the skirt.

12. The watercraft according to claim 1, also comprising two blocks, the two blocks being mounted on the inner wall of the hull and the seat including a seat cushion and a backrest, the seat cushion comprising holes with a shape complementary to that of the blocks and configured to cooperate with the blocks, and the backrest being intended to be supported on the transverse element of the stiffening upper structure.

13. The watercraft according to claim 1, wherein the bottom is formed of at least one inflatable shell, and wherein the stiffening upper structure is formed of the two lateral longitudinal inflatable shells and of at least one transverse element mounted between the two lateral inflatable shells.

14. The watercraft according to claim 1, in which the stiffening upper structure comprises two transverse elements mounted at a distance from one another between the two lateral inflatable shells, and wherein the transverse elements are inflatable, each comprising two superimposed walls, each of said walls including a textile mat and being connected together by a multitude of connecting threads distributed over the entire surface of said mats while forming a structure suited to be inflated to a pressure capable of stiffening said structure.

15. The watercraft according to claim 9, wherein the closing means is watertight.

16. The watercraft according to claim 1, wherein the watercraft is a kayak.

* * * * *